United States Patent [19]

Shimoda

[11] Patent Number: 4,601,231

[45] Date of Patent: Jul. 22, 1986

[54] ROTARY ACTUATOR AND MAKING METHOD THEREOF

[75] Inventor: Shinobu Shimoda, Tachikawashi, Japan

[73] Assignee: Torquer Co., Ltd., Tachikawa, Japan

[21] Appl. No.: 639,072

[22] Filed: Aug. 7, 1984

Related U.S. Application Data

[63] Continuation-in-part of Ser. No. 267,392, May 26, 1981, abandoned.

[51] Int. Cl.[4] ..... F15B 15/22; F01C 9/00

[52] U.S. Cl. ..... 91/26; 91/408; 92/122

[58] Field of Search ..... 92/122, 120, 121, 123, 92/124, 125; 91/408, 407, 409, 26

[56] References Cited

U.S. PATENT DOCUMENTS

| | | | |
|---|---|---|---|
| 2,798,462 | 7/1957 | Ludwig et al. | 92/125 |
| 2,922,397 | 1/1960 | Hoanes | 91/26 |
| 2,951,470 | 9/1960 | Self | 92/125 |
| 2,966,144 | 12/1960 | Self | 92/125 |
| 3,053,236 | 9/1962 | Self et al. | 92/122 |
| 3,456,562 | 7/1969 | Housen et al. | 92/122 |
| 3,592,104 | 7/1971 | Horness | 92/122 |
| 4,009,639 | 3/1977 | Sabashi | 91/408 |
| 4,027,576 | 6/1977 | Nomura | 92/122 |
| 4,192,224 | 3/1980 | Okamura | 92/125 |

*Primary Examiner*—Robert E. Garrett
*Assistant Examiner*—Mark A. Williamson
*Attorney, Agent, or Firm*—Browdy & Neimark

[57] ABSTRACT

A novel rotary actuator utilizes viscosity of the oil and prevents the oil leakage, without using the sealing member to the vane. The instant device installs the flanges in parallel and fixes the vane therebetween, and sets within the cylinder the rotor keeping the stopper therebetween, not fixing it, and the radial bearings at both sides of the cylinder to support the stopper, whereby a fine clearance is maintained between the flange and the inner wall of the cylinder. The rotor is formed in order of machining into flanges, small diameter portions and a rotary shaft. The vane is formed by cutting the material of doughnut shape into a sector.

6 Claims, 6 Drawing Figures

ROTARY ACTUATOR AND MAKING METHOD THEREOF

CROSS-REFERENCE TO RELATED APPLICATION

The present application is a continuation-in-part of U.S. application Ser. No. 267,392, filed May 26, 1981, now abandoned, the entire contents of which are hereby incorporated by reference.

FIELD OF THE INVENTION

The present invention relates to a rotary actuator facilitating reciprocating rotation and a method of making the actuator.

BACKGROUND OF THE INVENTION

In many applications, the opening and closing of doors of heavy weight, e.g. hatch covers of ships, large-scale butterfly vanes, or other various mechanisms, require a moving angle of less than one rotation. Generally, a rotary actuator is employed for providing reciprocating rotation (oscillation) having a limited angle.

The conventional rotary actuator substantially comprises a casing having a stopper secured to an inner wall thereof, a stator and vanes, and the reciprocating rotation (oscillation) has been accomplished by alternately supplying oil under pressure into inlet and outlet ports. In actuators of this type, the pressurized oil has been known to leak from a clearance defined at the casing inner wall, and the desired driving force cannot be provided. To overome this problem, sealing material such as rubber, synthetic resin or the like has been attached to the vanes. However, the sealing material suffers from severe abrasion, or creates friction relative to an inner side of the casing thereby significantly reducing efficiency of the actuator in generating rotation torque. For these reasons the need has arisen for a rotary actuator which prevents oil leakage without using sealing material.

SUMMARY OF THE INVENTION

It is therefore an object of the present invention to provide a rotary actuator which prevents oil leakage without securing sealing material to the vanes by utilizing only the viscosity of the oil.

Another object of the invention is to provide a method of making a rotary actuator which prevents oil leakage without using sealing material by relying only on the viscosity of the oil.

It is another object of the invention to provide a rotary actuator which may satisfactorily absorb sizing errors or setting-up errors, and to provide a method of making such an actuator.

A further object of the invention is to provide a rotary actuator which, upon assembly, maintains a fine clearance between the cylinder or casing inner wall and a flange rotor so that the oil does not penetrate into the casing, but securely supports the rotor, and to provide a making method thereof.

A still further object of the invention is to provide a method of making a rotary actuator which may exactly yield a diameter of the flange to a diameter of the vane to be kept between the flanges.

Other and further objects, features and advantages will appear more fully from the following description.

DETAILED DESCRIPTION OF PREFERRED EMBODIMENTS

An explanation will be made to preferred embodiments of the invention with reference to the attached drawings.

Figure 1:
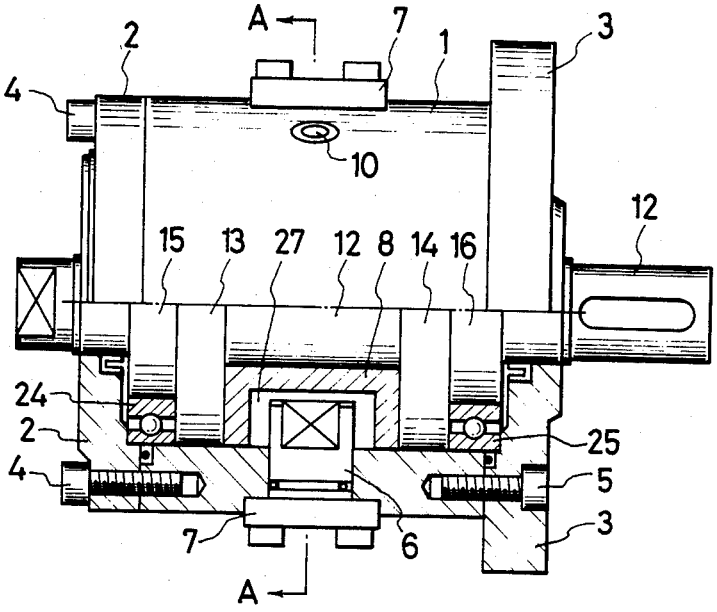
FIG. 1 shows partially a cross-sectional front view of an embodiment of the invention.

FIG. 1 shows a first partial cross-sectional front view of an embodiment according to the invention, in which two vanes are installed. Cylinder 1 includes a rotor mounted preferably concentrically therein, and is closed at both sides. The cylinder includes peripheral end covers 2 and 3 secured with bolts 4, 5, and has peripheral holes on diametrically opposed sides into which core metals will be inserted. The core metals 7 are secured to the cylinder 1 by tightening bolts. The core metal serves to restrain movement of stoppers 8, 9 as later mentioned. The cylinder 1 is further formed with oil ports 10, 11 around the core metal 7 for charging and discharging the oil under pressure.

Figure 2:
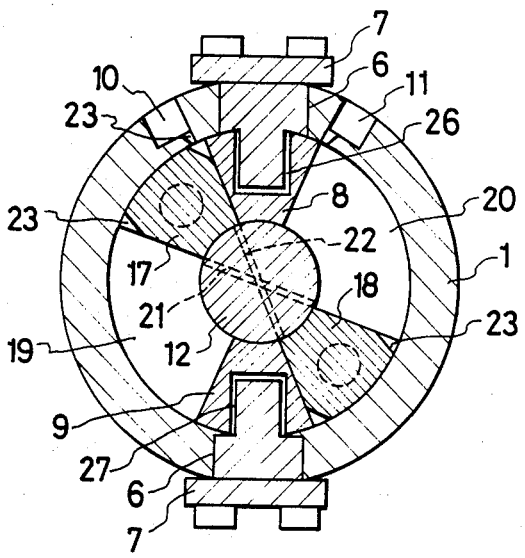
FIG. 2 is a cross-sectional view seen from line A—A in FIG. 1.
Figure 3:
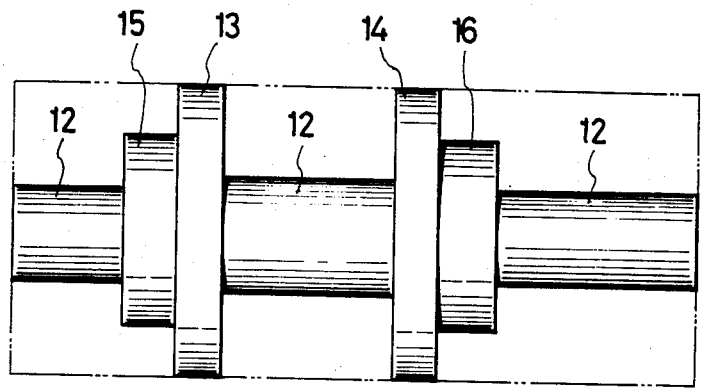
FIG. 3 is a front view of a rotor during the process of making the rotor.
Figure 4:
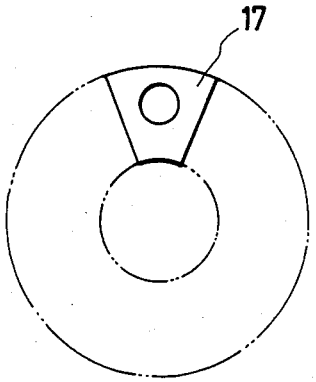
FIG. 4 is a side view of a vane during the process of making the vane.

The rotor mounted within the cylinder 1 comprises a rotor shaft 12, parallel flanges 13, 14 disposed substantially normal to the shaft, small diameter portions 15, 16 at outer sides of the flanges 13, 14, and vanes 17, 18 fixed between the flanges 13, 14. The rotor shaft 12 is formed with a narrow path 21 communicating oil chambers 19 and 20 as seen in FIG. 2, and a narrow path 22 communicating oil chambers which will be gradually defined between the stopper 8 and the vane 17, and between the stopper 9 and the vane 18 upon rotation of the rotor. The paths 21, 22 may be omitted if the vane and the stopper make one pair, and those may be also omitted if the cylinder 1 is formed on its lower face with oil ports similar to the oil ports 10, 11.

Preferably, the rotor is made in the following manner. That is, a circular material is provided which is of the same, or slightly larger, diameter as the flange. This material is machined on respective sides. At the outset, it is processed to a size of the diameter of the small diameter portions 15, 16, leaving parts which shall be the flanges 13, 14 at left and right sides. Thereafter, the processing is continued to a size of the diameter of the rotor shaft 12, leaving parts which will be the small diameter portions 15, 16. Thus, portions of the flanges 13, 14 the small diameter portions 15, 16 and the rotor shaft 12 are formed integrally and sequentially.

Proceeding in this manner, connections at respective parts are no longer, and accordingly no attention should be paid to discrepancy of error with respect to right angle, etc. In the instant actuator, the viscosity of the oil is utilized for preventing the oil leakaage without using, and in lieu of, sealing material for the vanes 17, 18. For this purpose, a clearance of microns is maintained so that oil leakage does not occur between the inner wall of the cylinder 1 and the circumferential faces of the flanges 13, 14. It is therefore preferable to manufacture the rotor as described above, since such precision (microns) is required for sizing and setting-up of each of the parts. For the vanes 17, 18 a cylindrical body such as a doughnut is provided which has an inner diameter equal to the diameter of the rotor shaft 12 and an outer diameter equal to, or a bit larger than, the outer diameter of the flanges 13, 14. The body is cut out at one part into a sector of small width and is held together by a bolt between the flanges 13, 14. In this manner, if the outer diameters of the vanes 17, 18 are prepared slightly larger than a predetermined outer diameter of the flange, it is possible to obtain the desired outer diameter of the flanges 13, 14 by grinding the vanes 17, 18 on protruding parts thereof from the flanges 13, 14 after having fixed the vanes 17, 18 between the flanges 13, 14. The vanes 17, 18 are secured to the flanges 13, 14 by the bolts. If the vanes 17, 18 are formed with cutouts 23, the oil smoothly penetrates between the contacting vane and stopper.

Fitting of the rotor into the cylinder 1 involves urging the rotor into cylinder 1 under the condition that the stoppers 8, 9 are kept between the flanges 13, 14 on the upper and lower parts thereof. The stoppers 8, 9 are positioned within spaces defined between the rotor shaft 12, the flanges 13, 14 and the inner wall of the cylinder 1, but are not fixed to any of them. Thus, thrust loading acting on the rotor shaft 12 may be absorbed and at the same time the sizing error or setting up error of each of the parts may be corrected. After the rotor has been inserted into the cylinder 1, radial bearings 24, 25 are forcibly set at both sides, the outer wheel of the bearings 24, 25 being a bit larger in the diameter than the inner diameter of the cylinder. The inner wheels of the radial bearings 24, 25 are mounted on the small diameter portions 15, 16 of the rotor. The rotor is securely supported by the radial bearings 24, 25, the outer wheel of which having a diameter larger than the inner diameter of the cylinder, so that the clearance is maintained between the circumferential faces of the flanges 13, 14 and the inner wall of the cylinder. The core metals 7 are inserted into the holes 6 and are fixed at end portions seated within bores 26, 27 of the stoppers 8, 9.

Figure 5:
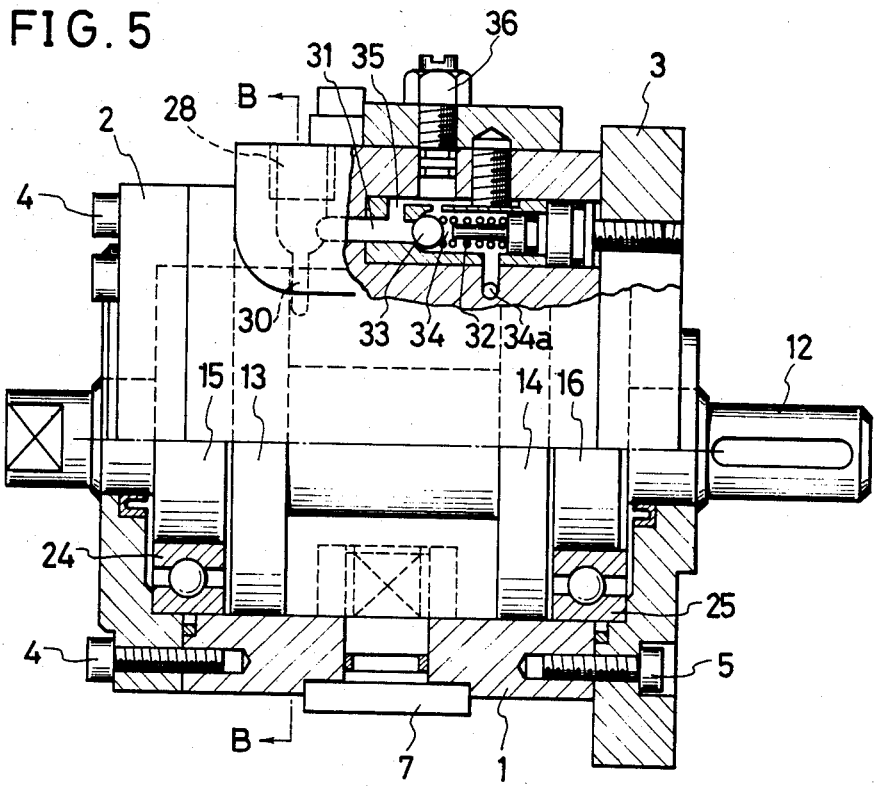
FIG. 5 shows partially a cross-sectional front view of another embodiment of the invention, and, FIG. 6 is a cross-sectional view seen from B—B line in FIG. 5.
Figure 6:
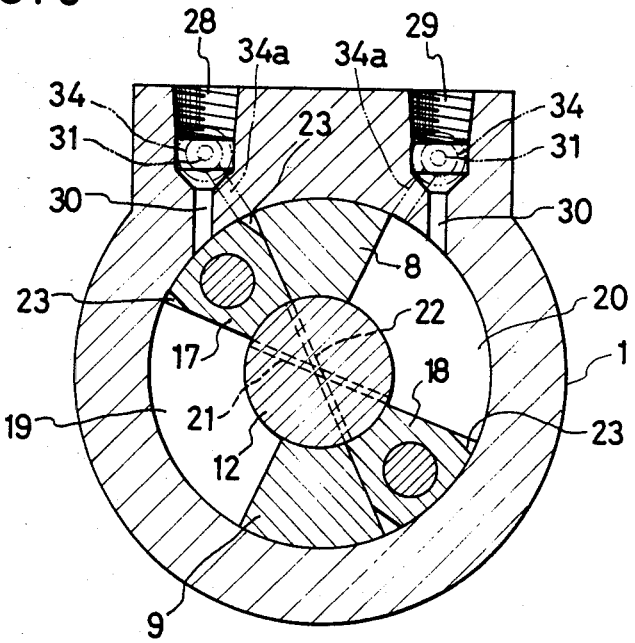

FIGS. 5 and 6 illustrate the other embodiment, in which a cushion mechanism is disposed.

In this embodiment, the oil ports 28, 29 are connected with main paths 30 and subpaths 31. The main paths 30 extend downwardly and directly communicate with the oil chambers 19, 20. The subpaths 31 extend downwardly and laterally to communicate with the paths 34. Within the paths 34, the ball valves 33 are disposed which are normally biased or pushed toward the subpaths 31 by springs 32. Each ball valve 33 serves to close the subpath 31, as long as a predetermined pressure is not exceeded within the subpath 31. Between the subpath 31 and the path 34, there is provided a bypath 34 having a flow capacity or effective volume which may be controlled by adjusting a control screw 36. The paths 34 communicate with oil chambers 19, 20 through passages **34*a***.

Operation of this embodiment is now explained. When the vanes 17, 18 and the stoppers 8, 9 are positioned against one another, as shown in FIG. 6, oil supplied from the oil port 28 flows into the subpath 31 since the vane 17 blocks the main path 30. A portion of the oil flows into the bypath 35, but the major part of the flow of the oil is directed at, and pushes against, the ball valve 33, in opposition to the spring 32. The force of the oil overcomes the force of the spring moving the ball valve 33 from its seat, and the oil behind the ball valve passes into the path 34. It joins the oil which has passed the bypath 35 (and flowed into the path 34) in the passage **34*a*, and bears against the cutout 23 (that is, between the vane 17 and the stopper 8). The vane 17 separates from the stopper 8 so that a new oil chamber is formed therebetween. At the same time, a part of the oil passes through the path 22 and reaches a boundary between the vane 18 and the stopper 9, and there effects a similar separation when rotation of the vane advances and the main path 30 is released, the oil being fed directly into a second diametrically opposed newly-formed oil chamber from the main path. Simultaneously, the oil in chamber 20 is discharged from the oil port 29 via the main path 30 as rotation of the vanes 17, 18 takes place. The oil in chamber 19 is pushed through the path 21 into the oil chamber 20, and is similarly discharged from the oil port 29. When the vane 18 closes the main path 30 of the oil port 29, the oil enters the path 34 from the passage 34*a* and exerts a force against the ball valve 33 in the same direction as the force of spring 32, and the subpath 31 is thus blocked. Thereafter, the oil flows into the bypath 35 and subsequently into the bypath 31. Since the bypath 35 is very narrow, the amount of oil flowing therethrough is abruptly reduced, and rotation of the rotor is restrained. In other words, a cushion effect is created so that the impact or shock of the vane 18 against the spring is moderated. Reverse rotation of the rotor is effected by reversing the procedure described above with respect to the oil ports 28, 29**.

In either embodiment, a thrust load applied to the rotary shaft is carried by the radial bearing 24, 25. The rotor facilitates both normal and reverse rotations, and a thrust load carried by the rotor is a component force other than a radial load. As long as the component force is light, it may be carried sufficiently by only the radial bearing. However, if a large thrust load were applied, the inner wheels of the radial bearings 24, 25 would sustain a slight bias toward the thrust in response to the extent of such thrust load, and the rotor also moves accordingly, even though the outer wheels of the radial bearings are so close to the inner face of the cylinder 1 and do not move. If, at this time, the stoppers 8, 9 were fixed to the inner wall of the cylinder 1, one of the flanges would be strongly urged against the stopper at its side by the thrust load, so that not only would reduction of the output torque result but also excessive friction which tends to prevent rotation of the rotor would be substantially eliminated.

In this way, in the present rotary actuator the stoppers 8, 9 are not fixed to the cylinder 1 at its inner wall. The stoppers 8, 9 may be moved while the rotor moves. Thus supported under this non-fixed condition, the stoppers 8, 9 move freely and fit closely to the adjacent members. Therefore, it is possible to adjust the sizing errors or the setting-up errors when the members are assembled.

Many widely different embodiments of this invention may be made without departing from the spirit and scope thereof, and therefore it is to be understood that the invention is not limited to the specific embodiments disclosed herein.

What is claimed is:

1. A rotary cylinder comprising:

a cylinder having an inner wall, end walls, and means interconnecting the interior of said cylinder with a source of viscous oil;

a shaft mounted in said cylinder and supported for rotation about its longitudinal axis, said shaft including opposed axially spaced flange means having an outer diameter, the outer diameter of said flange means being less than the diameter of said cylinder inner wall;

vane means, disposed on opposing sides of said shaft, including means for securing said vane means to and between facing surfaces of said opposing flange means, said vane means including opposed radial faces extending between said cylinder inner wall and said shaft;

stopper elements positioned between said flange means facing surfaces on diametrically opposing sides of said shaft, said stopper elements including opposed radial faces extending between said cylinder inner wall and said shaft;

means for restraining rotation of said stopper elements carried by said cylinder;

said vane means and said stopper elements defining therebetween at least one pair of variable volume chambers disposed on opposite sides of said shaft with one of said chambers being in communication with said interconnecting means;

means, extending through said shaft, for communicating one of said chambers of said pair with the other of said chambers;

radial bearing means supporting said flange means closely adjacent to said cylinder inner wall; and means for preventing leakage of oil from said chambers, said leakage preventing means consisting only of said flange means, said cylinder inner wall and said viscous oil, wherein each said flange means comprises a first portion and a second portion, said second portion having said outer diameter, said first portion being supported by a bearing supported by said bearing means, said preventing means including said second portion, and said first portion being of a lesser diameter than said second portion.

2. The rotary actuator of claim 1, wherein said vane means are secured between said second portions.

3. A rotary actuator, comprising:

a cylinder having an inner wall, end walls, and means interconnecting the interior of said cylinder with a source of viscous oil;

a shaft mounted in said cylinder and supported for rotation in a direction about its longitucinal axis, said shaft including opposed axially spaced flange means having an outer diameter, the outer diameter of said flange means being less than the diameter of said cylinder inner wall;

vane means, disposed on opposing sides of said shaft, including means for securing said vane means to and between facing surfaces of said opposing flange means, said vane means including opposed radial faces extending between said cylinder inner wall and said shaft;

stopper elements positioned between said flange means facing on diametrically opposing sides of said shaft, said stopper elements including opposed radial faces extending between said cylinder inner wall and said shaft;

means for restraining rotation of said stopper elements carried by said cylinder;

said vane means and said stopper elements defining therebetween two pairs of variable volume chambers, the chambers of each pair being disposed on opposite sides of said shaft with one of each pair of said chambers being in communication with said interconnecting means;

means, extending through said shaft, for communicating one of said chambers of each pair with the other of said chambers of the same pair;

radial bearing means supporting said flange means closely adjacent to said cylinder inner wall;

and means for preventing leakage of oil from said chambers, said leakage preventing means consisting only of said flange means, said cylinder inner wall and said viscous oil, wherein said interconnecting means comprises means for feeding said oil to one of the chambers of one pair and means for bypassing said feeding means when said feeding means is blocked by said vane means.

4. The rotary actuator of claim 3, wherein said bypassing means includes means for directing said oil to said one chamber when said feeding means is blocked.

5. The rotary actuator of claim 3, wherein said bypassing means includes means for reducing the flow of oil from said other pair of said chambers as the volume of said other pair of said chambers becomes reduced.

6. The rotary actuator of claim 5, wherein said reducing means comprises a pressure responsive check valve and an adjustable width bleed-off path, said check valve being in said bleed-off path and in pressure communication with said other pair of said chambers.

* * * * *